US009299223B2

(12) United States Patent
Guinn et al.

(10) Patent No.: US 9,299,223 B2
(45) Date of Patent: Mar. 29, 2016

(54) CONTROLLING BINGO GAME INTERACTIVITY

(75) Inventors: Andrew C. Guinn, Chicago, IL (US); Brian Morgan, Turvey (GB); James Palermo, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 847 days.

(21) Appl. No.: 13/109,510

(22) Filed: May 17, 2011

(65) Prior Publication Data

US 2011/0287823 A1 Nov. 24, 2011

Related U.S. Application Data

(60) Provisional application No. 61/346,225, filed on May 19, 2010.

(51) Int. Cl.

| | |
|---|---|
| ***A63F 3/06*** | (2006.01) |
| ***G07F 17/32*** | (2006.01) |
| ***G07F 17/34*** | (2006.01) |

(52) U.S. Cl.

CPC ..... *G07F 17/34* (2013.01); *G07F 17/32* (2013.01); *G07F 17/329* (2013.01); *G07F 17/3258* (2013.01)

(58) Field of Classification Search

CPC . G07F 17/32; G07F 17/3276; G07F 17/3288; G07F 17/0329

USPC ..... 463/19

See application file for complete search history.

(56) References Cited

U.S. PATENT DOCUMENTS

| | | | | |
|---|---|---|---|---|
| 7,727,064 | B1 | 6/2010 | Luciano, Jr. | |
| 7,731,581 | B2 | 6/2010 | Chamberlain et al. | |
| 7,828,656 | B2 | 11/2010 | Paulsen et al. | |
| 2005/0059470 | A1 | 3/2005 | Cannon | |
| 2005/0101387 | A1 | 5/2005 | Wolf | |
| 2005/0119042 | A1 | 6/2005 | Chamberlain et al. | |
| 2006/0025198 | A1 | 2/2006 | Gail | |
| 2006/0030399 | A1* | 2/2006 | Baerlocher | 463/20 |
| 2006/0046817 | A1 | 3/2006 | Paulsen | |
| 2006/0128454 | A1* | 6/2006 | Berman et al. | 463/13 |
| 2006/0205468 | A1 | 9/2006 | Saffari et al. | |

(Continued)

FOREIGN PATENT DOCUMENTS

| | | |
|---|---|---|
| WO | WO2005029426 | 3/2005 |
| WO | WO2005029427 | 3/2005 |

(Continued)

*Primary Examiner* — Lawrence Galka

(74) *Attorney, Agent, or Firm* — DeLizio Law, PLLC

(57) ABSTRACT

A wagering game system and its operations are described herein. In some embodiments, the operations can include providing gaming content for use during a bingo game, where the gaming content includes a representation of a bingo game card that includes card identifiers, arranged in a distinct pattern, which are usable during the bingo game to track game identifiers, with equivalent values, when drawn during the bingo game. The operations can further include selecting a card identifier, in response to user input, which indicates a user prediction that a corresponding game identifier, with an equivalent value, will be drawn during the bingo game. The operations can further include placing a bet for a secondary wagering game on the selecting of the card identifier, detecting a draw of the corresponding game identifier during the bingo game, and using the draw of the game identifier as an outcome for the bet.

24 Claims, 10 Drawing Sheets

(56) References Cited

U.S. PATENT DOCUMENTS

| | | | | |
|---|---|---|---|---|
| 2006/0287058 | A1 | 12/2006 | Resnick | |
| 2008/0113734 | A1* | 5/2008 | Watkins et al. | 463/19 |
| 2008/0254854 | A1* | 10/2008 | Slomiany et al. | 463/19 |
| 2010/0120489 | A1 | 5/2010 | Meyer | |
| 2010/0210339 | A1 | 8/2010 | Chamberlain | |
| 2011/0028201 | A1 | 2/2011 | Warner et al. | |
| 2011/0070951 | A1 | 3/2011 | Paulsen et al. | |

FOREIGN PATENT DOCUMENTS

| | | |
|---|---|---|
| WO | WO2005029428 | 3/2005 |
| WO | WO2006026543 | 3/2006 |
| WO | WO2008005278 | 1/2008 |
| WO | WO2008091468 | 7/2008 |

* cited by examiner

CONTROLLING BINGO GAME INTERACTIVITY

RELATED APPLICATIONS

This application claims the priority benefit of U.S. Provisional Application No. 61/346,225 filed May 19, 2010.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

TECHNICAL FIELD

Embodiments of the inventive subject matter relate generally to wagering game systems and networks that, more particularly, control interactivity between bingo game applications and additional wagering game applications.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers are constantly in need of innovative concepts that can make the online gaming industry appealing and profitable.

BRIEF DESCRIPTION OF THE DRAWING(S)

Embodiments are illustrated in the Figures of the accompanying drawings in which.

SUMMARY OF SOME EMBODIMENTS

Figure 1:
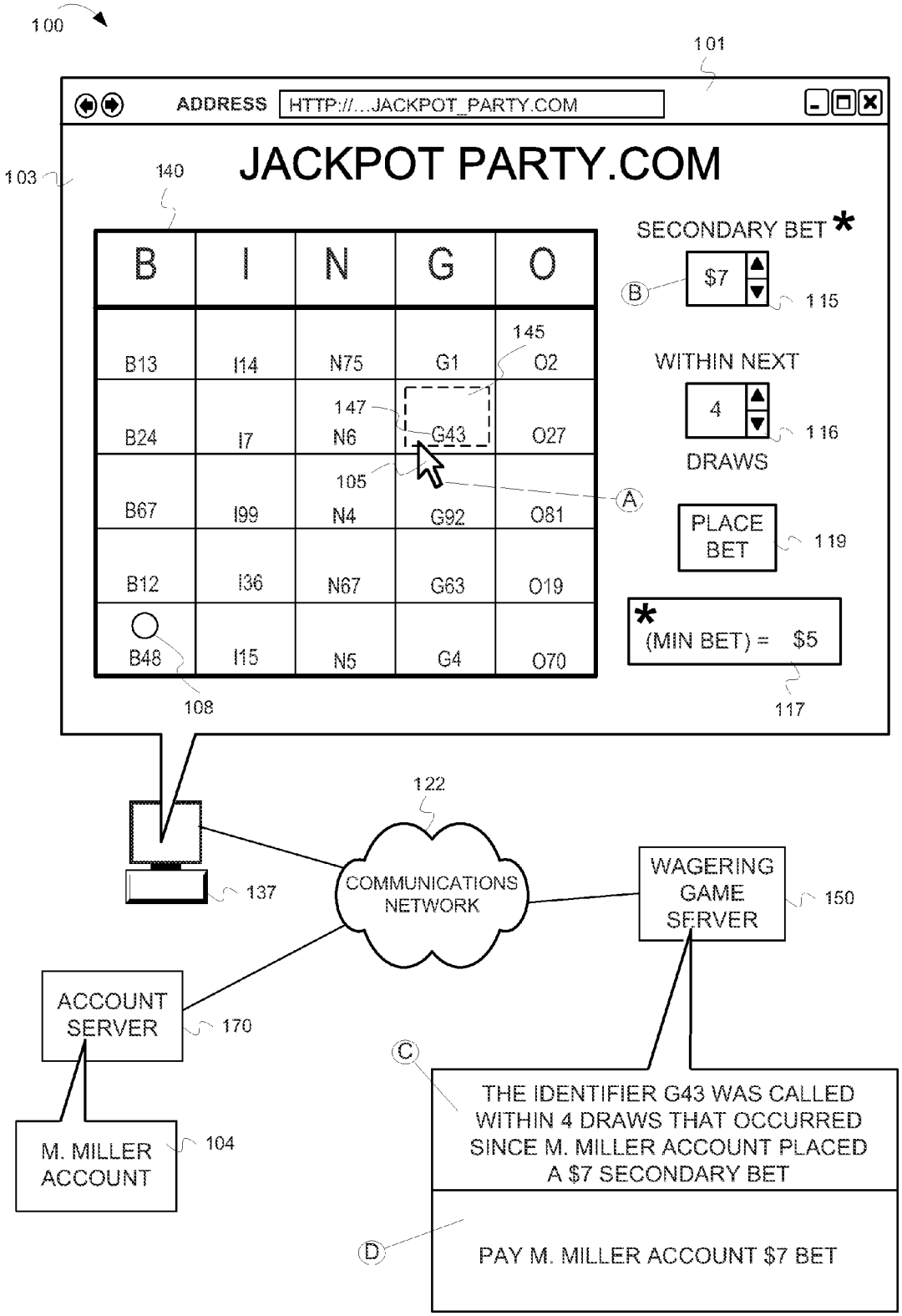
FIG. 1 is an illustration of controlling wagering activity in a secondary wagering game using bingo game activity, according to some embodiments.

In some embodiments, a computer-implemented method comprises providing gaming content for use during a bingo game, where the gaming content includes a representation of a bingo game card, the representation of the bingo game card includes card identifiers arranged in a distinct pattern on the representation of the bingo game card, and the card identifiers are usable during the bingo game to track game identifiers, with equivalent values, when drawn during the bingo game. In some embodiments, the computer-implemented method further comprises selecting one of the card identifiers of the representation of the bingo game card, in response to user input, where the selecting indicates a user-prediction that one of the game identifiers, equivalent in value to the one of the card identifiers, will be drawn during the bingo game. In some embodiments, the computer-implemented method further comprises associating the selecting of the one of the card identifiers with a secondary wagering game, placing a bet for the secondary wagering game on the selecting of the one of the card identifiers, detecting a draw of the one of the game identifiers during the bingo game, and using the draw of the one of the game identifiers as an outcome for the bet of the secondary wagering game. In some embodiments, the computer-implemented method further comprises determining a first period of game play for the bingo game, and limiting a second period of game play for the secondary wagering game based on the first period of game play for the bingo game. In some embodiments, the computer-implemented method comprises determining a betting restriction for the secondary wagering game based on a number of the game identifiers that have previously been drawn during the bingo game, and imposing the betting restriction on the bet before placing the bet. In some embodiments, the bingo game and the secondary wagering game operate independently from each other, and the placing the bet for the secondary wagering game has no impact on game play for the bingo game. In some embodiments, the computer-implemented method further comprises selecting, at random, a customized graphic provided via additional player input, where the additional player input is associated with a wagering game player account, presenting the customized graphic on the representation of the bingo card in association with the bingo game, and awarding the wagering game player account with a multiplier for the bet in the secondary wagering game. In some embodiments, the computer-implemented method comprises providing an interface for the secondary, wagering game, and detecting an additional user input, via the interface, where the additional input indicates a bet value for the bet. In some embodiments, the computer-implemented method comprises randomly selecting the one of the game identifiers for the bingo game, and providing an indication one of the game identifiers to the secondary, wagering game via an application programming interface. In some embodiments, the computer-implemented method comprises presenting an additional wagering game in response to the draw of the one of the game identifiers, determining that, the draw of the one of the game identifiers results in a winning outcome for the additional wagering game, and providing a reward for the winning outcome for the additional wagering game.

In some embodiments, one or more machine-readable storage media, having instructions stored thereon, which when executed by a set of one or more processors cause the set of one or more processors to perform operations that comprise presenting a wagering game on a graphical display, where the wagering game includes wagering game elements with images that change configurations during each play of the wagering game during a wagering game session. The operations can further include detecting an appearance of one configuration of the images during one play of the wagering game, determining that the appearance of the one configuration of the images is associated with one of a plurality of game identifiers for a bingo game, where the plurality of game identifiers are drawn during the bingo game. The operations can further include presenting a graphic of a bingo game card, where the graphic of the bingo game card includes a plurality of card identifiers, and where plurality of card identifiers are as subset of the plurality of game identifiers. The operations can further include determining that one of the plurality of card identifiers is equivalent in value to the one of the plurality of game identifiers. The operations can further include marking the one of the plurality of card identifiers on the graphic of the bingo game card as progress toward a winning outcome in the bingo game. In some embodiments, the operations can further comprise determining that the marking the one of the plurality of card identifiers causes the winning outcome for the bingo game, and providing an award in response to the determining the winning outcome. In some embodiments, the operations can further comprise making a game space associated with the bingo game card a wild space based on the appearance of the one configuration of the images. In some embodiments, the operations can further comprise prior to presenting the wagering game on the graphical display, presenting the graphic of the bingo game card, detecting a selection of the one of the plurality of card indicators, via user input, as a user-prediction that the one of the plurality of game indicators would occur during a playing round of the wagering game, determining a bet associated with the selection of the one of the plurality of card indicators, awarding the bet based on the occurrence of the one of the plurality of game indicators.

In some embodiments, a system comprises a wagering game server and a client. The wagering game server is configured to provide first wagering game content for a first wagering game to a client, and provide second wagering game content for a second wagering game to the client contemporaneously with provision of the first wagering game content, where the second wagering game content includes one or more wagering game elements used to present outcomes for the second wagering game. The wagering game server can further be configured to detect a bingo game event that occurs from the first wagering game, and cause the one of more wagering game elements to reconfigure appearance in the second wagering game content in response to the bingo game event that occurs from the first wagering game. The client is configured to present the first wagering game content and the second wagering game content during a wagering game session. In some embodiments, the one or more wagering game elements include one or more reels, and the wagering game server is further configured to spin the one or more reels in response to the event. In some embodiments, the wagering game server is further configured to detect a bet amount associated with the second wagering game, detect a winning outcome for the second wagering game in response to the reconfiguration of the appearance of the one or more wagering game elements, and award the bet based on the winning outcome. In some embodiments the wagering game server is further configured to detect a winning outcome in the second wagering game based on the reconfiguration of the appearance of the one or more wagering game elements, select an identifier from the bingo game based on the winning outcome in the second wagering game, and cause the identifier to be a wild game element in the bingo game on a representation of a bingo card included in the first wagering game content.

In some embodiments, an apparatus comprises one or more processors and a wagering game module. The wagering game module is configured to, via the one or more processors, detect, via a first user input, a purchase of bingo game cards for a bingo game during a wagering game session, where each of the bingo game cards includes card identifiers arranged on each of the bingo game cards in unique patterns that distinguish each of the bingo game cards. The wagering game module can further be configured to detect a selection, via a second user input, of a first of the card identifiers that appear on a first of the bingo game cards, and swap the first of the card identifiers with a second of the card identifiers from a second of the bingo game cards in response to the selection of the first of the card identifiers that appear on the first of bingo game cards. In some embodiments, the wagering game module can further be configured to require a payment of a fee from a player account, detect a payment of the fee from the player account, via a third user input, before swapping the first of the card identifiers with the second of the card identifiers, and swap the first of the card identifiers with the second of the card identifiers after the payment of the fee. In some embodiments, the wagering game module can further be configured to present an additional wagering game during a wagering game session contemporaneously with the bingo game, detect an occurrence of an outcome for the additional wagering game, and swap the first of the card identifiers with the second of the card identifiers based on the occurrence of the outcome for the additional wagering game. In some embodiments, the wagering game module can further be configured to detect that a game identifier, equivalent in value to the second of the card identifiers, has been drawn during the bingo game, and provide an award for the second of the card identifiers appearing on the first of the bingo game cards.

In some embodiments, an apparatus comprises means for presenting a bingo game card during a bingo game, wherein the bingo game card comprises card identifiers that are a subset of game identifiers that can potentially be drawn during the bingo game, and wherein the card identifiers are usable during the bingo game to track one or more of the game identifiers when drawn. The apparatus can further comprise means for selecting, in response to player input, a portion of the card identifiers of the bingo game card, where the means for selecting indicates a user-prediction that a portion of the game identifiers with equivalent values to the portion of the card identifiers will be drawn during the bingo game. The apparatus can further comprise means for associating the portion of the card identifiers with a secondary wagering game, where the bingo game and the secondary wagering game operate independently from each other. The apparatus can further comprise means for determining a betting restriction for the secondary game based, at least in part, on a total number game identifiers that have been drawn for the bingo game. The apparatus can further comprise means for placing a bet for the secondary wagering game, according to the betting restriction, based on the selecting of the portion of the card identifiers. The apparatus can further comprise means for detecting a draw of the portion of the game identifiers during the bingo game session. The apparatus can further comprise means for using the draw of the portion of the game identifiers as an outcome for the bet of the secondary wagering game, wherein the outcome for the bet of the secondary game has no impact on the bingo game. The apparatus can further comprise means for providing an award for the secondary wagering game in response to the outcome. In some embodiments, the means for placing the bet for the secondary wagering game comprises means for presenting a betting control that receives bets for the secondary wagering game, and means for detecting an additional player input via the betting control that indicates a bet value. In some embodiments, the apparatus can further comprise means for determining a first period of game play for the bingo game, and means for limiting a second period of game play for the secondary wagering game based on the first period of game play for the bingo game. In some embodiments, the apparatus can further comprise means for selecting, at random, a customized graphic provided by a wagering game player account associated with the bingo game, means for presenting the customized graphic on the bingo card in association with the bingo game, and means for entering the wagering game player account into a sweepstakes based on the presenting the customized graphic on the bingo card. In some embodiments, the means for detecting the draw of the number of the identifiers during the bingo game session comprises means for generating random numbers for the bingo game, means for using the random numbers to draw the portion of the game identifiers for the bingo game, and means for notifying the secondary game of that the portion of the game identifiers are drawn.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Wagering games are expanding in popularity. Many wagering game enthusiasts are demanding greater access to wagering games and content related to wagering games. As stated previously, some wagering game companies have created online wagering game websites that provide a way for wagering game enthusiasts to play wagering games while connected to the Internet (e.g., via a web-browser). Some online wagering game websites provide various features, such as social networks and social networking functionality. Social networks allow wagering game players ("players") to create social network user accounts with one or more unique identifiers that represent an online persona. One example of a unique identifier is an "avatar." Avatars are graphical, cartoon-like depictions of a social network persona. These online personas and associated avatars add to the fin of belonging to an online gaming community. Many wagering game providers, however, continue to search for new and innovative ways to make their content appeal to a broader audience, such as gaming audiences that enjoy different types of wagering games, including bingo.

FIG. 1 is a conceptual diagram that illustrates an example of controlling wagering activity in a secondary wagering game using bingo game activity, according to some embodiments. In FIG. 1, a wagering game system ("system") 100 includes a computer 137 connected to a wagering game server 150 via a communications network 122. Also included in the system 100 is an account server 170 connected to the communications network 122. The account server 170 host can host a wagering game account (e.g., player account 104 for the user "Marcus Miller"). A user (i.e., Marcus Miller) can log in to the player account 104 via a web browser 101 presented by the computer 137. The web browser 101 can also present an online wagering website ("website") 103 (e.g., "Jackpot Party.com") hosted by the wagering game server 150. The wagering game server 150 can provide bingo gaming content (e.g., a bingo game that includes a graphic of a bingo game ticket or bingo game card ("bingo card") 140 purchased by the player account 104). The website 103 can present the gaming content, which the player account 104 can utilize during a wagering game session. A bingo game is a specific type of group wagering game where a controller (e.g., the wagering game server 150) randomly selects, draws, or "calls" distinct bingo game elements, or game "identifiers" in a repeating manner until a specific configuration of equivalently valued card identifiers on a player's bingo card is filled (e.g., until a row or column of card identifiers are completed on the bingo card 140). The card identifiers appear on any one of the bingo cards in a unique or distinct pattern. The card identifiers are used during a bingo game session to track game progress on the bingo game card. In other words, when the controller draws a game identifier, and if an equivalently valued card identifier is on a player's bingo card, the system 100 can place a marker 108, a daub, or other indicator, on the bingo card to track the drawn game identifier and mark progress, on the bingo card, toward a winning outcome in the bingo game.

Figure 4:
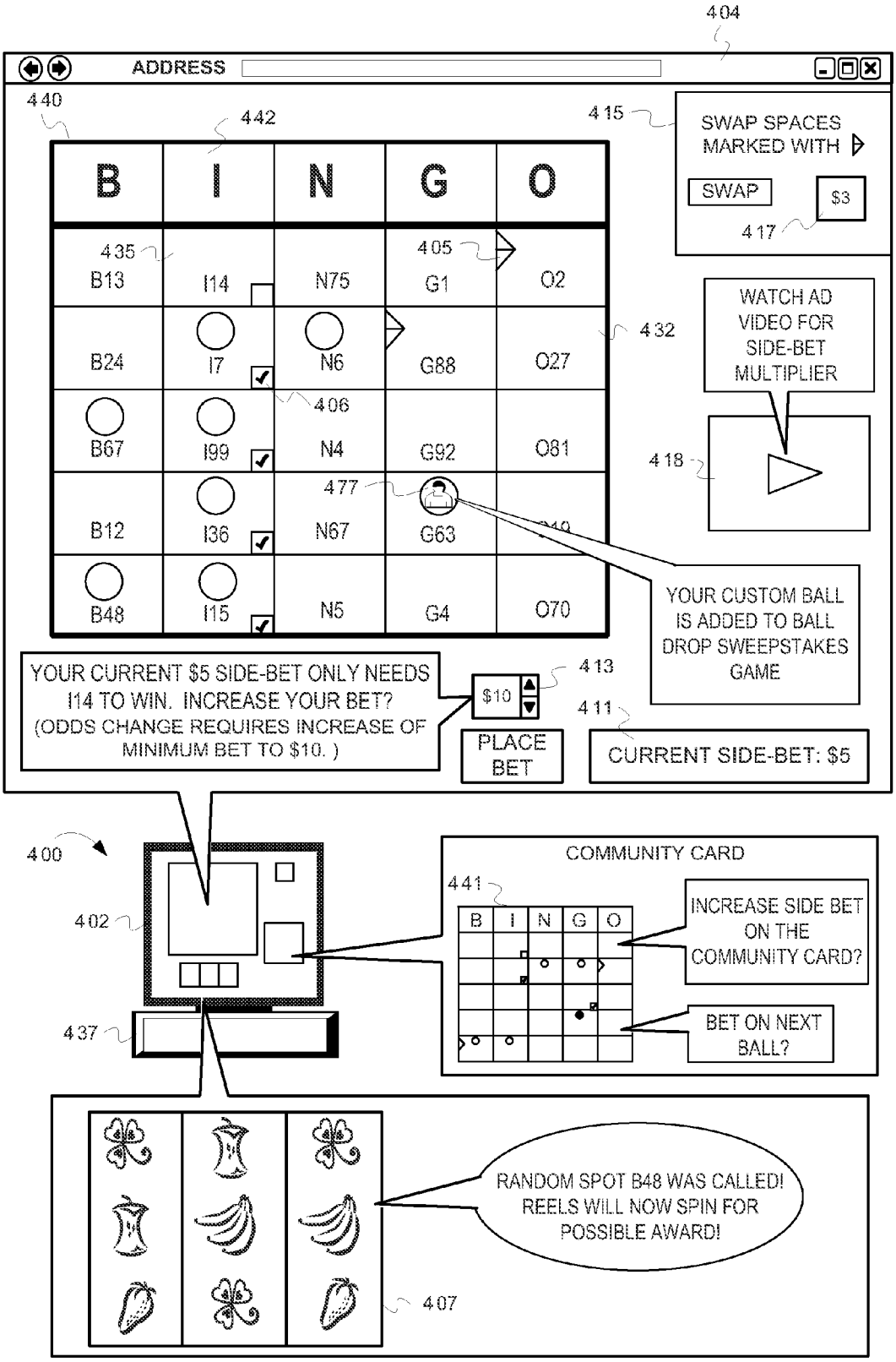
FIG. 4 is an illustration of causing secondary wagering activity in response to bingo game activity, according to some embodiments.

In some embodiments, the system 100 can present a secondary wagering game, separate from the bingo game, but that uses elements of the bingo game, for example, to determine outcomes for the secondary wagering game. For instance, the system 100 provides controls, or other means, for a player to select one or more desired game spaces (e.g., game space 145) on the bingo card 140. In this description, selected game spaces, such as game space 145, may be referred to as a "player-specified" game spaces because the game space(s) are specified by a player using a selection device (e.g., a mouse cursor 105). In some embodiments, a player can select multiple game spaces in a configuration that the player desires. FIG. 4, described in more detail further below, shows an example where a player selects an entire column of game spaces (e.g., column 442) indicated by check boxes (e.g. checkbox 406). In this description, configurations of selected game spaces, may be referred to as "player-specified" configurations because a player specifies (e.g. selects, indicates, etc.), the locations of game spaces on a bingo card. In some embodiments, a player-specified configuration can be a pattern, a random grouping of spots or numbers, or whatever the player wants to specify.

At stage "A" in FIG. 1, a player selects the game space 145 using the mouse cursor 105. At stage "B," after the player selects the game space 145, the player indicates a bet amount for a secondary bet, using a bet value control 115, then selects a bet placement control 119 to enter the bet. The player places the bet amount for a prediction that an identifier 147 (i.e., "G43") associated with the game space 145 will be drawn during the bingo game. If the identifier 147 is drawn, then the player wins the bet amount or some money value related to the bet amount. The secondary wagering game can use the secondary bet for the secondary game only, such as a side bet related to the secondary game so that when the player-specified configuration hits and wins an award in the secondary game, the player wins the bet amount for the secondary wagering game only, and the underlying bingo game continues unaffected. The bet, therefore, is not a bet for the bingo game. The bet, instead, is for the secondary wagering game that occurs concurrently with the bingo game, and uses the elements of the bingo game, but is performed separate and independent from the bingo game. In other words, the secondary wagering game uses the game elements of the bingo card 140 to determine results for the secondary wagering game. However, the secondary wagering game uses separate rules from the bingo game. For instance, a bingo game may include a first set of rules that require a player to fill in an entire row or column of a bingo card to win the bingo game. However, the secondary wagering game can include rules that determine whether player-specified spaces are drawn during the course of the bingo game, but the rules of the secondary game do not interact with, or affect, the course of the bingo game.

The secondary wagering game can also impose a restriction, such as a time limit, a restriction on a number of draws, etc., on the secondary wagering game that is related to a restriction for the bingo game. For example, the system can require that the player-specified configuration be completed before the bingo game completes. In one embodiment, the system 100 provides a limit control 116, which limits the period in which the secondary bet for the secondary wagering game is active. For example, the limit control 116 can indicate a number of subsequent calls, or draws, for the bingo game during which the bet is active (e.g., a player indicates the number "4" in the limit control 116 to indicate that the player predicts that the identifier 147 (i.e., "G43") will be called within the next four calling turns, or draws, of the bingo game (i.e., within the next four draws of bingo game pieces). In one embodiment, at stage "C," the wagering game server 150 calls the identifier 147 within the number of turns, or draws, of the bingo game indicated in the limit control 116 after the player has placed the secondary bet. At stage "D," the wagering game server 150 then pays the secondary bet to the player account 104.

The system can also propose minimum betting limits (e.g., impose a minimum bet amount, impose a minimum bet increment amount, etc.) for the player's secondary bet. The minimum betting limits can depend on a complexity or difficulty in fulfilling a player-specified configuration based on a history of the bingo game play, a number of card spaces completed on the bingo card 140, a time limit, a number of play turns indicated by a player's prediction, etc. The system can pay out more for player selections of configurations that are complex or difficult, and as a result may require a higher minimum betting increment. For example, the system 100 can determine a complexity or difficulty of a specific configuration indicated on the bingo card 140 based on the number, indicated in the limit control 116, of subsequent bingo turns, or draws. A higher number on the limit control 116 would provide greater odds that the identifier 147 would be drawn. A lower number on the limit control 116 would provide lower odds that the identifier 147 would be drawn. As a result, the system 100 can modify a minimum bet increment amount that is tied to the number of the limit control 116, such as requiring lower minimum bet increment amounts for lower numbers and higher minimum bet increment amounts for higher numbers. The system 100 can indicate the minimum bet increment amount in a minimum bet indicator 117. The system 100 can also automatically restrict the bet control 115 from presenting less than the minimum bet increment amount. In other example, the system 100 can modify a payout amount for the game depending on the aforementioned complexity or difficulty in fulfilling a player-specified configuration based on the history of the bingo game play, the number of card spaces completed on the bingo card 140, the time limit, the number of play turns indicated by a player's prediction, etc.

Further, some embodiments of the inventive subject matter describe examples of controlling interactivity between bingo game applications and additional wagering game applications in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
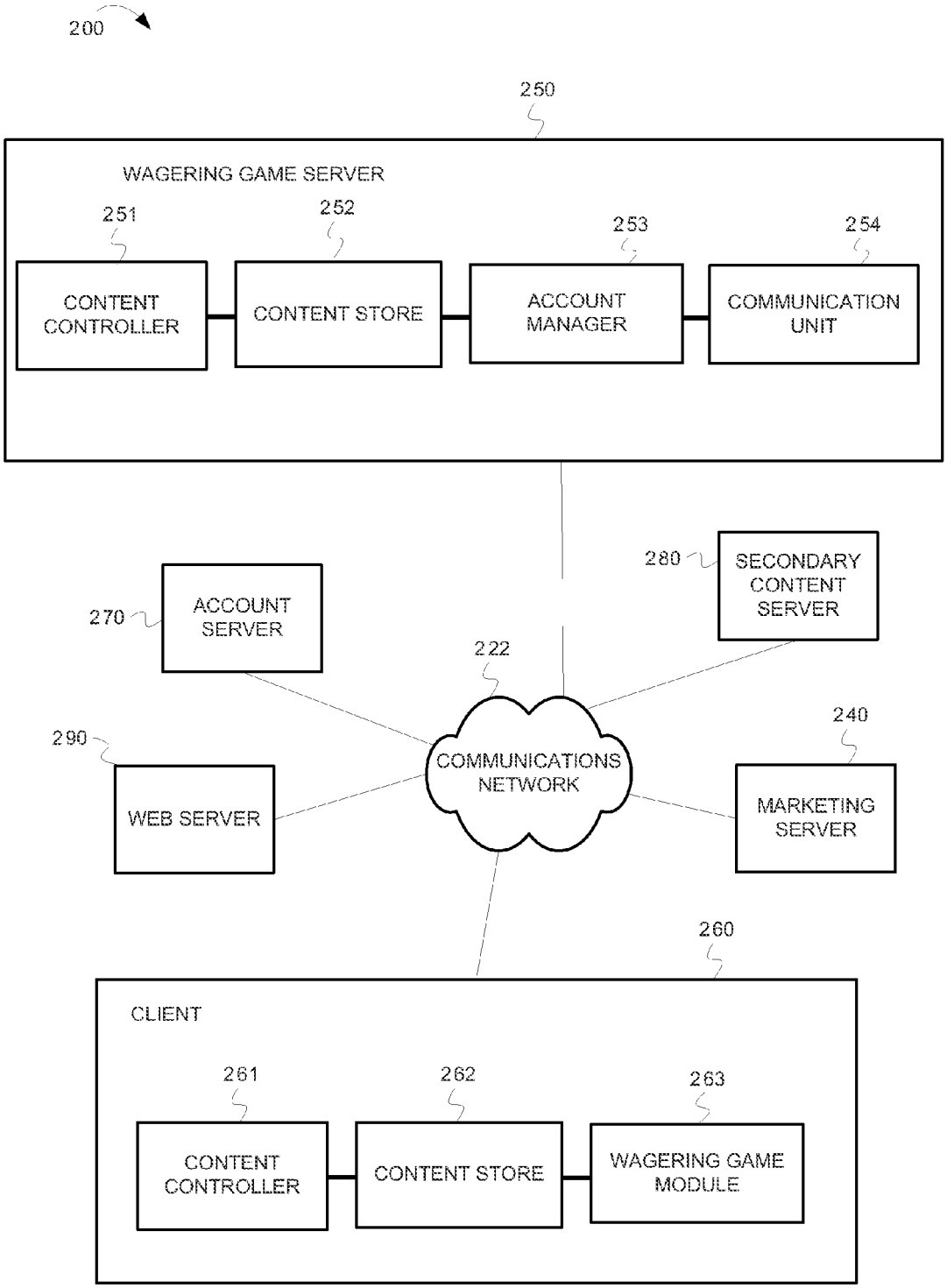
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networking networks. The account server 270 can store wagering game player account information, such as account settings (e.g., settings related to bingo games, wager amounts, etc.), preferences player preferences regarding bingo game interactivity with additional wagering games, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 270 can contain lists of social contacts referenced by a player account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from a client 260. The wagering game server 250 can include a content controller 251 configured to manage and control content for the presentation of content on the client 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. In some embodiments, the content controller 251 can further control interactivity between bingo game applications and additional wagering game applications. For example, the content controller 251 can control effects of gaming conditions (e.g., events, properties, states, etc.) between wagering applications, such via an application programming interface (API) for bingo game applications and/or for additional wagering game applications. For example, the content controller 251 can detect a first condition in a bingo game and cause a separate second condition to occur in an additional wagering game in response to the first event, or vice versa. The wagering game server 250 can also include a content store 252 configured to contain content to present on the client 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the client 260 and to communicate with other systems, devices and networks.

The wagering game system architecture 200 can also include the client 260 configured to present wagering games, and receive and transmit information to control interactivity between bingo games and additional wagering games. The client 260 can be a computer system, a personal digital assistant (PDA), a cell phone, a laptop, a wagering game machine, or any other device or machine that is capable of processing information, instructions, or other data provided via the communications network 222. The client 260 can include a content controller 261 configured to manage and control content and presentation of content on the client 260. The client 260 can also include a content store 262 configured to contain content to present on the client 260. The client 260 can also include a wagering game module 263 configured to process communications, commands, or other information, where the processing can control interactivity between bingo games and additional wagering games. The wagering game module 263 can perform any function that any other system component can perform regarding controlling bingo game and additional wagering game interactivity and/or processing data and control information provided by any of the other system components.

The wagering game system architecture 200 can also include a web server 290 configured to control and present an online website that hosts wagering games and other wagering activity.

The wagering game system architecture 200 can also include a secondary content server 280 configured to provide content and control information for secondary games and other secondary content available on a wagering game network secondary wagering game content, promotions content, advertising content, player tracking content, web content, etc.). The secondary content server 280 can provide "secondary" content, or content for "secondary" games presented on the client 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application programming interfaces), thus becoming, or falling under the control of, primary content or primary applications, and vice versa.

The wagering game system architecture 200 can also include a marketing server 240 configured to utilize player data to determine marketing promotions that may be of interest to a player account. The marketing server 240 can also analyze player data and generate analytics for players, group players into demographics, integrate with third party marketing services and devices, etc. The marketing server 290 can also provide player data to third parties that can use the player data for marketing. In some embodiments, the marketing server 240 can analyze player data to award a random bonus depending on how much a player has lost. The award can be a monetary award, an advertising coupon, free bingo cards, etc.

Each component shown in the wagering game system architecture 200 is shown as a separate and distinct element connected via the communications network 222. However, some functions performed by one component could be performed by other components. For example, the wagering game server 250 can also be configured to perform functions of the wagering game module 263 and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the client 260 instead of, or in addition to, being a part of the wagering game server 250. Further, in some embodiments, the client 260 can determine wagering game outcomes, generate random numbers, etc. instead of, or in addition to, the wagering game server 250.

As mentioned previously, in some embodiments, the client 260 can take the form of a wagering game machine. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, clients and wagering game servers work together such that clients can be operated as thin, thick, or intermediate clients. For example, one or more elements of game play may be controlled by the client or the wagering game servers (server). Game play elements can include executable game code, lookup tables, configuration files, game outcome, audio or visual representations of the game, game assets, or the like. In a thin-client example, the wagering game server can perform functions such as determining game outcome or managing assets, while the clients can present a graphical representation of such outcome or asset modification to the user (e.g., player). In a thick-client example, the clients can determine game outcomes and communicate the outcomes to the wagering game server for recording or managing a player's account.

In some embodiments, either the client or the wagering game server(s) can provide functionality that is not directly related to game play. For example, account transactions and account rules may be managed centrally (e.g., by the wagering game server(s)) or locally (e.g., by the client). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
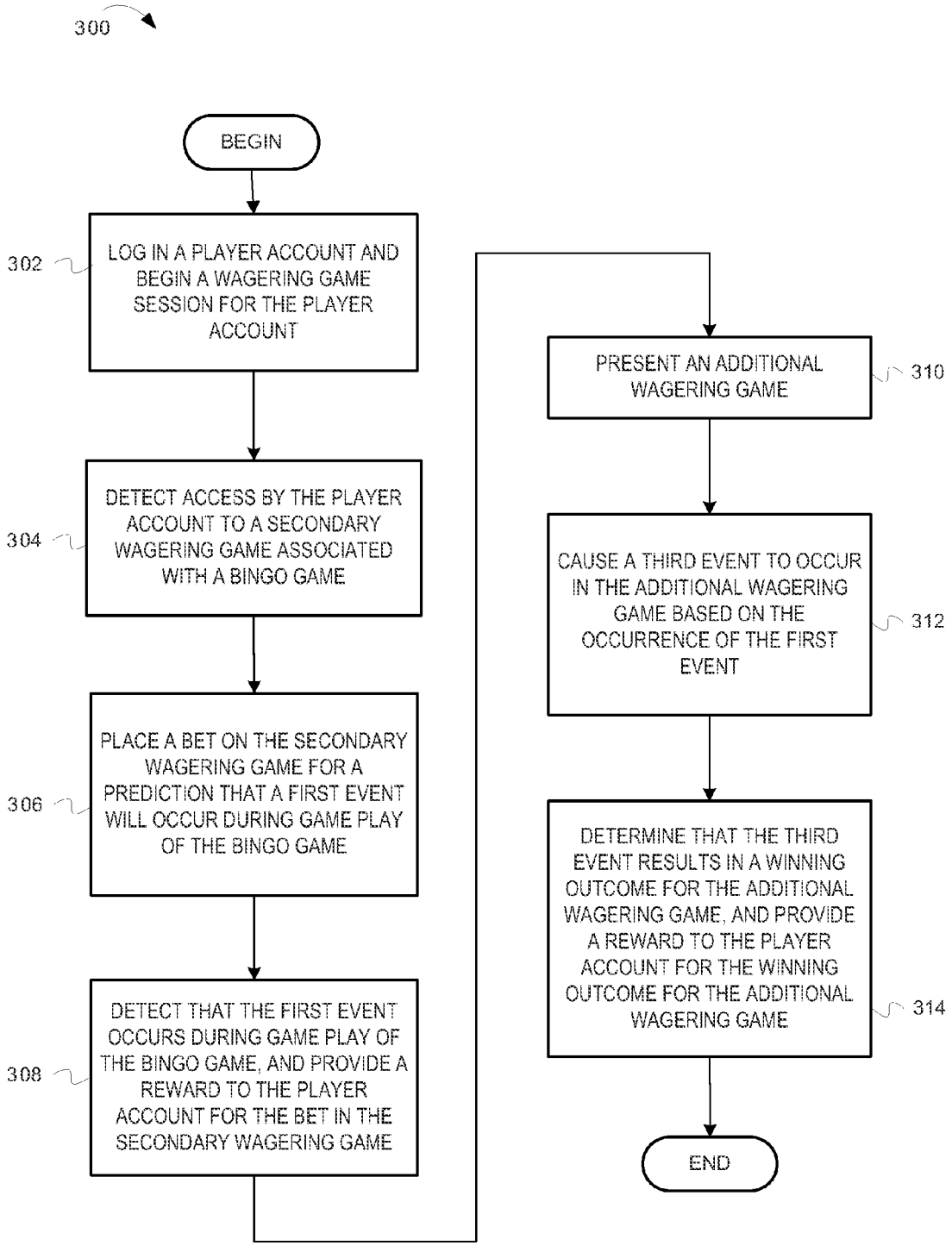
FIG. 3 is a flow diagram 300 illustrating controlling, interactivity between bingo games and additional wagering games, according to some embodiments.

FIG. 3 is a flow diagram 300 illustrating controlling interactivity between bingo games and additional wagering games, according to some embodiments. FIGS. 1, and 4 are conceptual diagrams that help illustrate the flow of FIG. 3, according to some embodiments. This description will present FIG. 3 in concert with FIGS. 1 and 4. In FIG. 3, the flow 300 begins at processing block 302, where a wagering game system ("system") logs in a player account and begins a wagering game session for the player account.

The flow 300 continues at processing block 304, where the system detects access by the player account to a secondary wagering game associated with a bingo game. In some embodiments, the system can present secondary games associated with bingo games. Activities or outcomes for the secondary games can depend on bingo game events. Examples of bingo game events can include a bingo game outcome, a unique outcome value from the bingo game, an occurrence of a specific bingo game space identifier, a completion of a row or column in a bingo game, etc.

The flow 300 continues at processing block 306, where the system places a bet on the secondary wagering game for a prediction that the first event will occur during game play of the bingo game.

The flow 300 continues at processing block 308, where the system detects that the first event occurs during the game play of the bingo game and provides a reward to the player account for the bet in the secondary wagering game. FIG. 1 above illustrated one example of a wagering game system that can transact bets made on predicted game activities, or occurrences of specific outcomes, in a bingo game, but that transacts the bets as part of a secondary wagering game separate from the bingo game. For instance, as described previously in FIG. 1, the system 100 presented the bingo card 140 during a bingo game session, and selected, in response to player input, one of the identifiers identifier 147) or a game space 145 associated with the identifier, of the bingo game card. The system 100 associated the selection by the player with a secondary wagering game and placed a bet for the secondary wagering game on the selecting of the identifier 147. The system 100 can detect a call, or draw, of the identifier 147 during the bingo game session, and can use the draw of the identifier 147 as an outcome for the bet of the secondary wagering game. The system 100 can further provide an award for the secondary wagering game in response to the placing the bet.

FIG. 4 illustrates yet another example of a secondary game where a player can bet on possible occurrence of events in a bingo game. FIG. 4 shows an example of a wagering game system ("system") 400 with a computer 437. The computer 437 includes a display 402. The system 400 can present at least one secondary game on the display 402 via a web browser 404. The web browser 404 presents bingo game content, such as a bingo card 440. The web browser 404 also presents secondary game content that uses elements of the bingo card 440. For example, the system 400 selects, via player input at the computer 437, an entire column 442 of the bingo card 440. The system 400 indicates the selection of the column 442, such as by placing a checkbox (e.g., checkbox 406) in each game space of the column 442. When a game identifier is drawn for the any of the game spaces in the column 442, the system 400 places a check indicator in the checkbox (e.g., a check graphic in the checkbox 406). The system 400 detects a side-side-bet made on a player-specified configuration of the game spaces (e.g., the player selected all of the game spaces in the column 442). The side-bet is indicated in the current side-side-bet indicator 411. The side-bet is similar to the secondary bet described in FIG. 1, although in FIG. 1, only one game space was selected whereas in FIG. 4, many game spaces are selected. Similar to the system 100 of FIG. 1, the system 400 can provide a bet control 413 that a player can use to increase a bet amount for the side-wager as the bingo game progresses. For instance, the bingo card 440 only needs the identifier "I14" associated with game space 435 to complete the player-specified configuration of column 442. As a result, the player's minimum side bet increases if the player wants to modify the side-bet using the bet control 413.

In some embodiments, the system 400 can detect an event from a bingo game and, randomly select player-customized images (e.g., customized patterns, textures, graphics, etc.). For instance, in FIG. 4, a player can choose a unique symbol before the bingo game begins. Other players can also choose symbols that are unique to the other players. During the bingo game, the system 400 can randomly select one or more of the symbols (e.g., player-customized image 477) for one or more of the players to mark the bingo card 440 for some of the game identifiers that are called, or drawn, during the bingo game. When the system 400 randomly selects the player-customized image 477, the system 400 can cause events to occur within the bingo game or in secondary wagering games. For example, the system 400 can increase a player's chances to win in the bingo game. In another example, the system 400 can increase a win amount in a secondary wagering game.

In some embodiments, the system 400 can use an occurrence of a randomly selected player-customized image to affect sweepstakes types of games. For example, the system 400 can cause an entry into a sweepstakes, add additional playing elements, or entries, for a player into a sweepstakes, cause a multiplier effect on existing entries in a sweepstakes, etc. A specific type of sweepstakes game is a "ball drop" game, which utilizes unique looking balls that a player has customized as entries into a sweepstakes. A player customizes the look of a ball with an avatar, a personal graphic, a specific set of colors, etc., and the system 400 present a player-customized image associated with a customized ball during the bingo game. For instance, the system 400 presents the player-customized image 477 in the bingo game as a marker for the bingo card 440. The player-customized image 477 may be associated with a customized ball by the player for a ball drop game. When the player-customized image 477 appears in the bingo game, the system 400 adds a corresponding ball into a ball bag for the ball drop game. The system 400 can then trigger a beginning to the ball drop game. The ball drop game can then draw player's customized balls from the ball bag. Depending on when a player's ball is drawn during the ball drop game, the system 400 can provide higher or lower awards. For example, the ball drop game can provide greater rewards as fewer balls remain in the ball bag, where the highest award goes to the last ball selected from the ball bag. In some embodiments, the system 400 may repeat presentation of the player-customized image 477 during the bingo game. For each repetition of the player-customized image 477, the system 400 can add an additional instance of the corresponding ball to the ball drop game. Thus, in some embodiments, as the player-customized image 477 is repeatedly presented, more balls are added for the player to the ball drop game, and the player's chances increase more in the ball drop game of having a ball that is selected last. In other embodiments, however, when the player-customized image 477 is presented more than once, instead of adding another ball into the ball drop bag, the system 400 can add a multiplier effect to the corresponding customized ball that is already in the ball bag. Thus, if the player's ball wins during the ball drop game, the system 400 would apply the multiplier to any award.

The flow 300 continues at processing block 310, where the system presents an additional wagering game. The additional game can be a secondary wagering game independent from the bingo game, but associated with the bingo game's activity.

The flow 300 continues at processing block 312, where the system causes a third event to occur in the additional wagering game based on the occurrence of the first event.

The flow 300 continues at processing block 314, where the system determines that the third event results in a winning outcome for the additional wagering game and provides a reward to the player account for the winning outcome for the additional wagering game. For example, in some embodiments, the system can provide a community bingo card with a single winning combination. The system can present the community bingo card as a secondary game in connection with the bingo game. In some embodiments, however, community bingo card can be presented by other wagering games (e.g., slot games) instead of or in addition to, being presented by the bingo game. The system displays the community bingo game to every player (i.e., on every player's computer the system presents one bingo card). For example, in FIG. 4, the system 400 presents the community bingo card 441. A player can use the system 400 to place a secondary wager for the community bingo card 441 at any time during the bingo game. Similarly as described above, player's can place additional side-bets on predictions of game identifiers for the community bingo game card 441. The amount of the additional side-bets can depend on how close the community bingo card 441 is to completing and triggering the community bonus. As the community bingo card 441 continues to complete, the system 400 increases a minimum bet limit level. In some embodiments, the system 400 can use events that occur to game elements of the bingo game associated with the bingo card 440 or to the secondary game associated with the bingo game. For example, the system 400 can determine whether the bingo game draws a certain game identifier that appears on the bingo card 140, then, in response, launches the community bingo card 441. In another example, the system 400 can determine whether the player makes and/or wins a secondary bet, then, in response, launches the community bingo card 441.

In some embodiments, the system 400 can present another wagering game, such as reels that spin based on an event in the bingo game. For example, the system 400 can present reel(s) 407 to appear on the display 402. The system 400 can cause the reel(s) 407 to spin based on an event in the bingo game. The system 400 can also provide awards for configurations of reel elements that occur when the reel(s) 407 spin. In some embodiments, the configurations (e.g., outcomes) of the reel elements can affect the bingo game, such as by providing multipliers for the bingo game. Other embodiments may use playing cards, a roulette wheel, dice, or other types of wagering game elements, instead of, or in addition, to reels to present outcomes based on an event in the bingo game.

In some embodiments, the system 400 can select random "hot spots" associated with game spaces on the bingo card 440. When the system 400 draws a game identifier for one of the hot spots, the system 400 can subsequently spin the reel(s) 407. For instance, the system 400 draws the identifier "O27" on the bingo card 440, which corresponds to the game space 432 on the bingo card 440. The identifier "O27" is a hot spot selected randomly by the system 400. Thus, the system 400 can cause the reel(s) 407 to spin based on the drawing of the "O27" identifier and the appearance on the game space 432 on the bingo game card 440. In other embodiments, instead of hot spots, the system 400 can present "cold spots" or poopers in the bingo game (e.g., when a cold spot is selected, the system 400 can replace an already drawn and marked bingo card identifier with an undrawn, or unmarked bingo card identifier, when a cold spot is selected, the system 400 can reduce award values in the reel game, etc.). In some embodiments, the system 400 has complete control over the reel(s) 407, or in other words, the system 400 does not provide any control to the player to spin the reel(s) 407. The system 400 can cause the reel(s) 407 to spin entirely dependent on the hot spots of the bingo game. The reel(s) 407 can have an associated pay table and the system 400 can generate payouts based on the pay table. The reel(s) 407 can also have a bonus symbol that triggers several different bonus opportunities, such as a picking game, a free spin game, entries into a community game free future bingo cards, etc. The bonus game could also award a multiplier that would be applied to the bingo card 440 that triggered the spin. If the bingo card 440 happens to be a winning card for the bingo game, the amount that the card pays out can be multiplier for awards provided from outcomes for the reel(s) 407. In some embodiments, the game with the reel(s) 407 runs on its own random generated numbers, which are separate from random generated numbers for the bingo game. In some embodiments, a player can have some input or other control on the reel(s) 407. For example, the player can choose a specific wagering game theme or denomination to use for the reel(s) 407. The system 400 can make a player's degree of control on the reel(s) 407, or elements associated with the reel(s) 407, dependent on a number of loyalty points or a degree of status that the player has. In some embodiments, the system 400 can pay for awards for reel outcomes using a portion of wagers made for the bingo game. In some embodiments, the system 400 can also accept secondary wagers on the outcomes of the reel(s) 407. The secondary wagers are separate from wagers made for the bingo game, and therefore can be any value higher or lower than minimum or maximum bet amounts for the bingo game.

Figure 5:
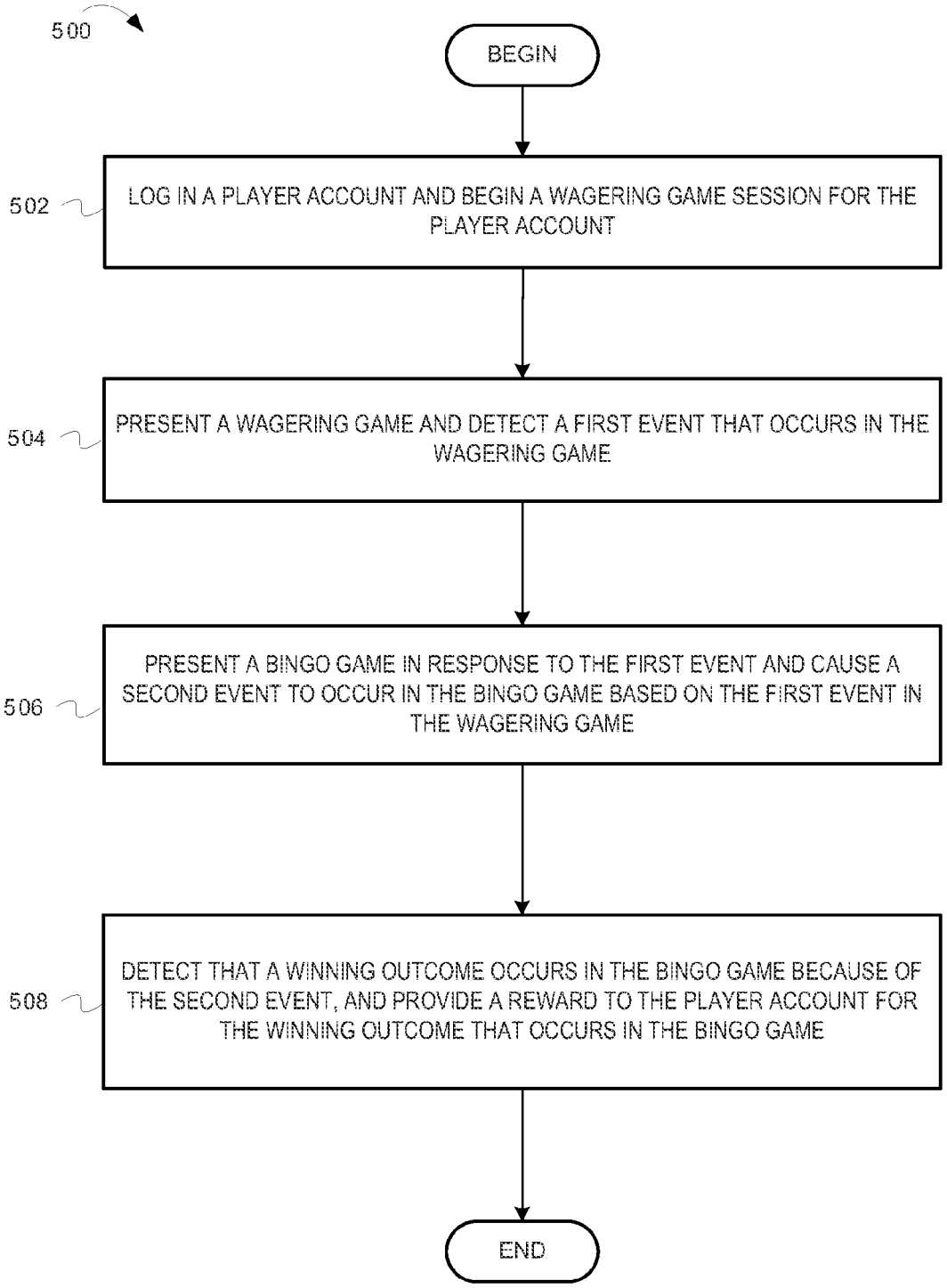
FIG. 5 is a flow diagram 500 illustrating controlling interactivity between a primary wagering game and a bingo game, according to some embodiments.
Figure 6:
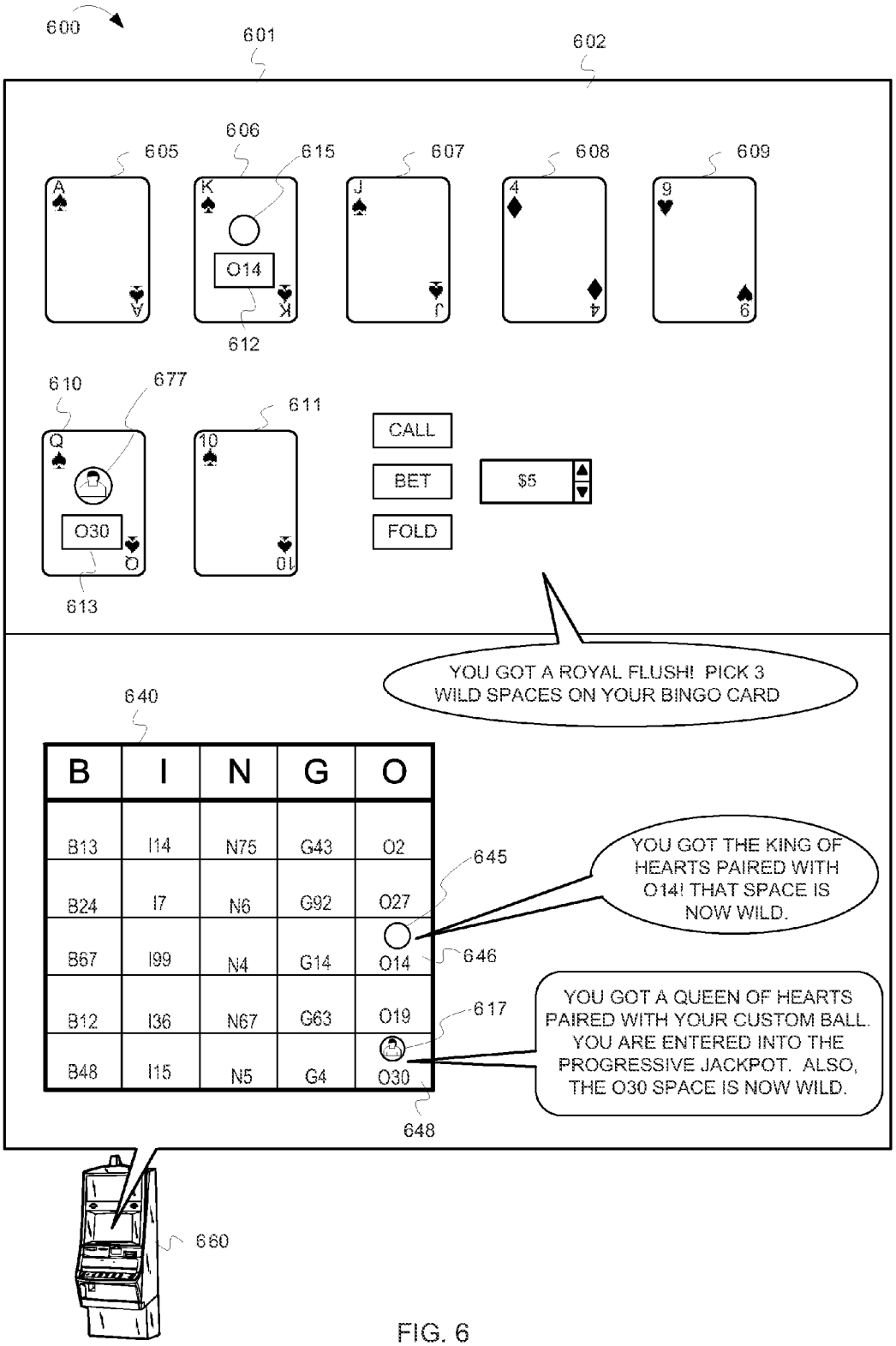
FIG. 6 is an illustration of causing secondary bingo game activity in response to primary wagering game activity, according to some embodiments.

FIG. 5 is a flow diagram 500 illustrating controlling interactivity between a primary wagering game and a bingo game, according to some embodiments. FIG. 6 is a conceptual diagram that helps illustrate the flow of FIG. 5, according to some embodiments. This description will present FIG. 5 in concert with FIG. 6. In FIG. 5, the flow 500 begins at processing block 502, where a wagering game system ("system") logs in a player account and begins a wagering game session for the player account.

The flow 300 continues at processing block 310, where the system presents a wagering game and detects a first event that occurs in the wagering game. The wagering game can be a primary wagering game or "base" game. Examples of primary games include slot games, electronic poker games, etc. where a player can place wagers on each play or turn in the game (e.g. place a bet on each reel spin, place a bet on each turn of a card, place a bet on each spin of a roulette wheel, place a bet on each round of poker play, etc.).

The flow 300 continues at processing block 310, where the system presents a bingo game in response to the first events and causes a second event to occur in the bingo game based on the first event in the wagering game.

The flow 300 continues at processing block 310, where the system detects that a winning outcome occurs in the bingo game because of the second event, and provides a reward to the player account for the winning outcome that occurs in the bingo game.

For instance, in FIG. 6, a wagering game system ("system") 600 includes a wagering game machine 660. The wagering game machine 660 presents a primary wagering game 602 in a display 601. The primary wagering game 602 is, for example a poker game (although other embodiments may include a slot game, or any other type of wagering game). The poker game includes community cards 605, 606, 607, 608 and 609 (i.e., cards 605-609) as well as player cards 610, 611. The combination of community cards 605-609 and the player cards 610, 611 provide a game outcome for the player. One of the outcomes can include a specific poker hand, such as a royal flush (i.e., the combination of community cards 605, 606, 607 and player cards 610, 611 which together present at least five cards with the same suit having the card values from 10 through Ace). The system 600 can present a secondary game, such as a bonus bingo game represented by the bingo card 640. The system 600 can then cause an event to occur in the bonus bingo game. In some embodiments, the system 600 can prompt the player to select wild spaces on the bingo card 640 because of the event that occurred in the primary wagering game 602 (e.g., the system 600 can prompt the player to select three wild spaces on the bingo card 640).

The system 600 can also cause specific events to occur in the bingo game when certain game cards elements appear in the primary wagering game 602 or when bingo game elements appear in the primary wagering game 602. For example, when the community card 606 (i.e., King of Hearts) appears in the primary wagering game 602, either by design or by random selection, the system 600 can present an identifier 612 and a graphic 615 on the community card 606. If the identifier 612 is on the bingo card 640, for instance at bingo card space 646, the system 600 can place a marker 645 on the bingo card space 646, or in some other way indicate that the bingo card space 646 is wild in response to the graphic 615 appearing along with the identifier 612 on the community card 606.

In some embodiments, the system 600 can detect the appearance of a unique graphic (e.g., player-customized graphic 677). The system 600 can provide extra awards for a customized marker. For example, when the system 600 detects the presentation of the player-customized graphic 677 on the player card 610, the system 600 may enter a player into a progressive jackpot. The player card 610 may include an additional identifier 613. The system 600 can further place an additional bingo marker 617 on a bingo card space 648 associated with the identifier 613, or in some other way indicate that the bingo card space 648 is wild in response to the player-customized graphic 677 appearing along with the identifier 613 on the player card 610.

Additional Example Embodiments

According to some embodiments, a wagering game system ("system") can provide various example devices, operations, etc. to control interactivity between bingo games and additional wagering games. The following non-exhaustive list enumerates some possible embodiments.

- In some embodiments, the system can select a portion of bets made during a bingo game (e.g., take a portion of payments made for bingo cards) and add that portion of the bets to a progressive jackpot.
- In some embodiments, the system can detect multiple possible wins set for one spot on the bingo card in secondary wagering games. If someone wins at the bingo game, the system can continue drawing game identifiers for the bingo game to determine outcomes for the secondary games.
- In some embodiments, the system can swap card identifiers from one bingo game card that a player has paid for to another bingo game card a player has paid for. For example, in FIG. 4, a player may have a certain identifier value on a first bingo card (not shown) and that exact identifier value is needed for a bingo win on a second card (e.g., on the bingo card 440). The system 400 can swap the value from the first card to the second card in response to a player selecting a control (e.g., the swap space control 415). The system 400 can also require the player to pay a fee 417 to swap the card identifiers based on a number of spaces selected by the player. In some embodiments, the system 400 can randomly select the spaces to swap. In some embodiments, the system 400 can show the values that were swapped or that will be swapped using one or more graphics (e.g., graphic 405).

In some embodiments, the system can detect non-gaming (e.g., marketing) player activity outside of bingo game, and cause gaming activity to occur within bingo game based on the non-gaming player activity. For example, in some embodiments the system can providing advertising content during a gaming session for online bingo game, wherein the advertising content indicates a marketing activity that a player can perform. The system can detect performance of the marketing activity during the gaming session, and, consequently, award a bingo game element based on the marketing activity. For example, in FIG. 4, the system 400 can present an advertisement ("ad") 418 and detect when a player clicks on the ad 418 (or performs other activity, such as watching a video, browsing help pages, etc.). The system 400 can then add a one-time wild to a player's bingo card, fill in a winning combination of gaming elements on the bingo card, or provide other rewards related to the bingo card. A sponsor (e.g., an e-tailer establishment) can sponsor awards. The system 400 can provide emails from sponsor to players notifying of awards or congratulating of awards. In some embodiments, the system 400 can make a player's bonus in a game dependent on performing the non-gaming activity.

In some embodiments, the system can perform bingo games in a land-based casino instead of, or in addition to, performing bingo games online. The bingo games and other secondary and primary wagering games can interact with each between venues (e.g.; between online and land-based casinos). For example, in some embodiments; a ball draw can occur within a land-based casino and an online player can see the ball draw occur. A player can buy cards online. In some embodiments, rewards can be higher for in casino bingo games than for online bingo games to drive players into a land-based casino.

Additional Example Operating Environments

This section describes example operating environments, systems and networks, and presents structural aspects of some embodiments.

Wagering Game Computer System

Figure 7:
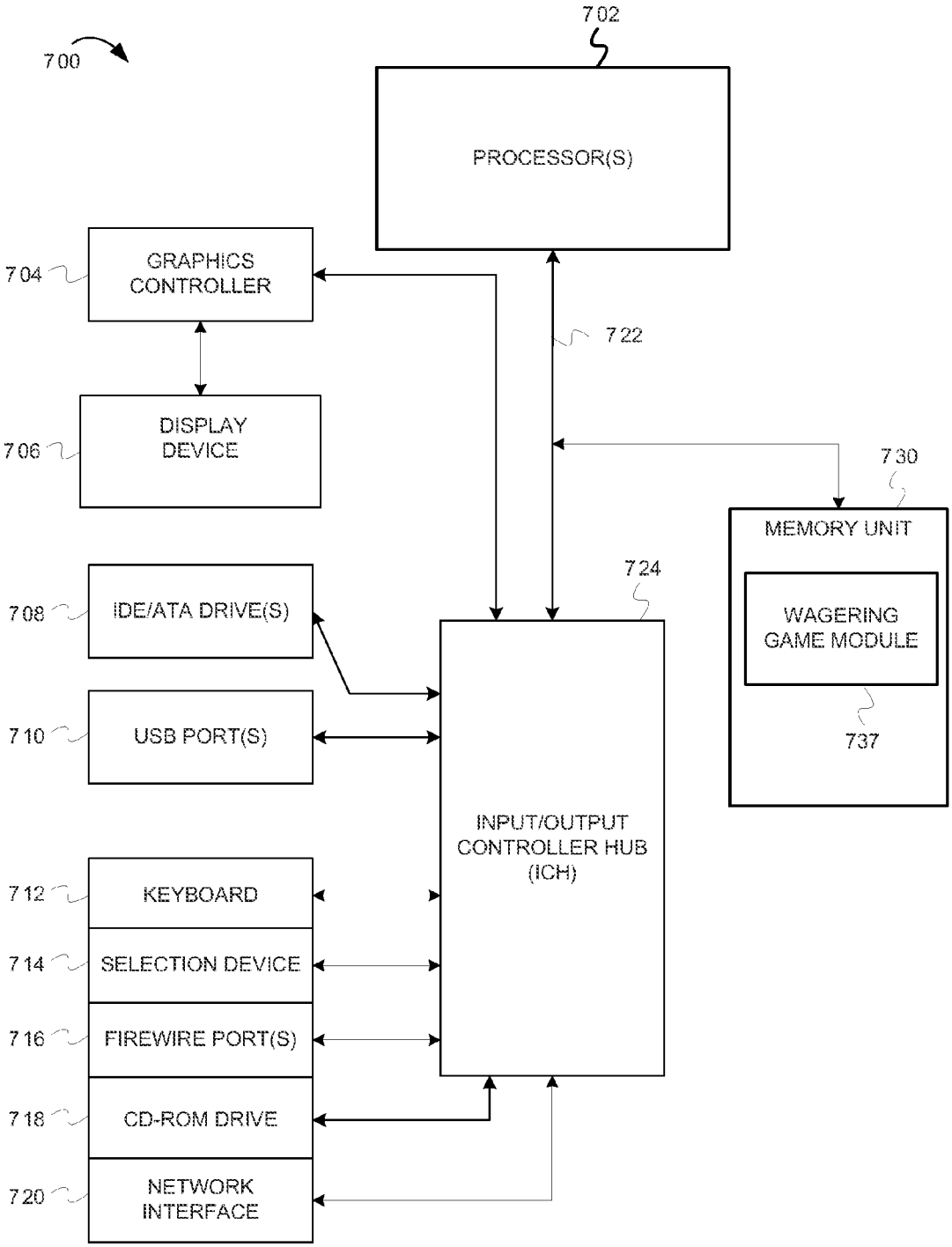
FIG. 7 is an illustration of a wagering game computer system 700, according to some embodiments.

FIG. 7 is a conceptual diagram that illustrates an example of a wagering game computer system 700, according to some embodiments. In FIG. 7, the wagering game computer system ("computer system") 700 may include a processor unit 702, a memory unit 730, a processor bus 722, and an Input/Output controller hub (ICH) 724. The processor unit 702, memory unit 730, and ICH 724 may be coupled to the processor bus 722. The processor unit 702 may comprise any suitable processor architecture. The computer system 700 may comprise one, two, three, or more processors, any of which may execute a set of instructions in accordance with some embodiments.

The memory unit 730 may also include an I/O scheduling policy unit and I/O schedulers. The memory unit 730 can store data and/or instructions, and may comprise any suitable memory, such as a dynamic random access memory (DRAM), for example. The computer system 700 may also include one or more suitable integrated drive electronics (IDE) drive(s) 708 and/or other suitable storage devices. A graphics controller 704 controls the display of information on a display device 706, according to some embodiments.

The input/output controller hub (ICH) 724 provides an interface to I/O devices or peripheral components for the computer system 700. The ICH 724 may comprise any suitable interface controller to provide for any suitable communication link to the processor unit 702, memory unit 730 and/or to any suitable device or component in communication with the ICH 724. The ICH 724 can provide suitable arbitration and buffering for each interface.

For one embodiment, the ICH 724 provides an interface to the one or more IDE drives 708, such as a hard disk drive (HDD) or compact disc read only memory (CD ROM) drive, or to suitable universal serial bus (USB) devices through one or more USB ports 710. For one embodiment, the ICH 724 also provides an interface to a keyboard 712, selection device 714 (e.g., a mouse, trackball, touchpad, etc.), CD-ROM drive 718, and one or more suitable devices through one or more firewire ports 716. For one embodiment, the ICH 724 also provides a network interface 720 though which the computer system 700 can communicate with other computers and/or devices.

The computer system 700 may also include a machine-readable storage medium that stores a set of instructions (e.g., software) embodying any one, or all, of the methodologies for control interactivity between bingo games and additional wagering games. Furthermore, software can reside, completely or at least partially, within the memory unit 730 and/or within the processor unit 702. The computer system 700 can also include a wagering game module 737. The wagering game module 737 can process communications, commands, or other information, to control interactivity between bingo games and additional wagering games. Any component of the computer system 700 can be implemented as hardware, firmware, and/or machine-readable storage media including instructions for performing the operations described herein.

Personal Wagering Game System

Figure 8:
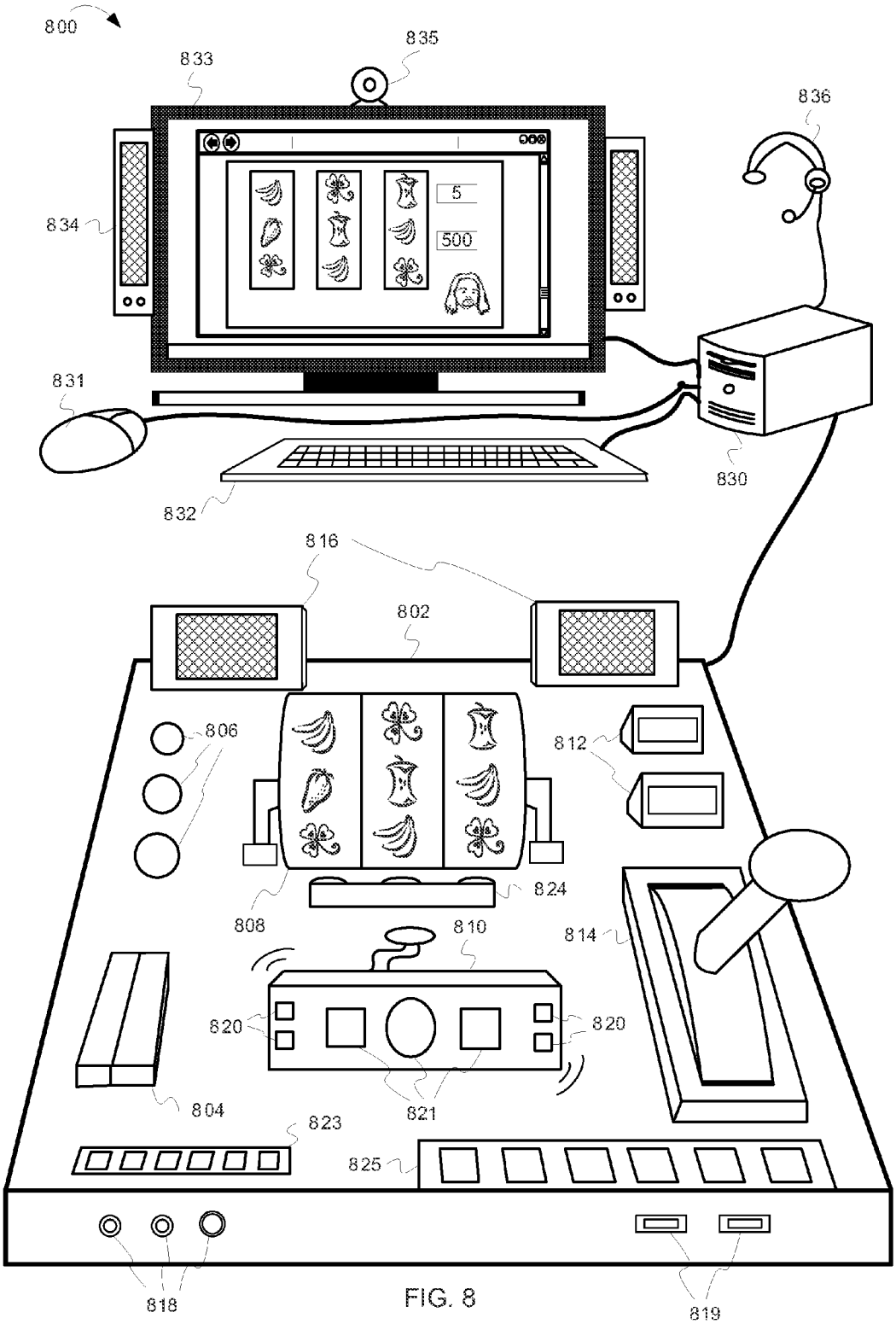
FIG. 8 is an illustration of a personal wagering game system 800, according to some embodiments.

FIG. 8 is a conceptual diagram that illustrates an example of a personal wagering game system 800, according to some embodiments. In FIG. 8, the personal wagering game system ("system") 800 includes an exemplary computer system 830 connected to several devices, including user input devices (e.g., a keyboard 832, a mouse 831), a web-cam 835, a monitor 833, speakers 834, and a headset 836 that includes a microphone and a listening device. In some embodiments, the webcam 835 can detect fine details of a person's facial features, from an eye-level perspective. The web-cam 835 can use the fine detail to determine a person's identity, their demeanor, their facial expressions, their mood, their activities, their eye focus, etc. The headset 836 can include biometric sensors configured to detect voice patterns, spoken languages, spoken commands, etc. The biometric sensors in the web-cam 835 can detect colors (e.g., skin colors, eye colors, hair colors, clothing colors, etc.) and textures (e.g., clothing material, scars, etc.). The biometric sensors in the web-cam 835 can also measure distances between facial features (e.g., distance between eyes, distance from eyes to nose, distance from nose to lips, length of lips, etc.). The system. 800 can generate a facial and body, map using the detected colors, textures, and facial measurements. The system 800 can use the facial and body map to generate similar facial features and body appearances for a player account avatar. Also connected to the computer system 830 is a gaming control device ("gaming pad") 802 including wagering game accoutrements associated with wagering games. The wagering game accoutrements include one or more of prop reels 808, prop game meters 812, indicators 806, a game control device 810, a physical lever 814, a magnetic card reader 804, a video projection device 824, input/output ports 818, USB ports 819, and speakers 816. The gaming pad 802 can present feedback of online activities. For instance, the gaming pad 802 can use vibrations and signals on the gaming control device (e.g., the game control device 810 or the physical lever 814 can vibrate to indicate a back pat from another player or a game celebration, the indicators 806 can blink, etc.). The physical lever 814 can produce feelings in the lever to emulate a pulling feel or a vibration. The video projection device 824 can project video onto the prop reels 808 so that the prop reels 808 can present many different types of wagering games. The prop reels 808 can spin when the physical lever 814 is pulled. The video projection device 824 can project reel icons onto the prop reels 808 as they spin. The video projection device 824 can also project reel icons onto the prop reels 808 when the prop reels 808 are stationary, but the imagery from the video project device 824 makes the prop reels 808 appear to spin. The magnetic card reader 804 can be used to swipe a credit card, a player card, or other cards, so that the system can quickly get information. The system 800 can offer lower rates for using the magnetic card reader 804 (e.g., to get a lower rate per transaction). The game control device 810 can include an emotion indicator keypad with keys 820 that a player can use to indicate emotions. The game control device 810 can also include biometric devices 821 such as a heart-rate monitor, an eye pupil dilation detector, a fingerprint scanner, a retinal scanner, voice detectors, speech recognition microphones, motion sensors, sound detectors, etc. The biometric devices 821 can be located in other places, such as in the headset 836, within a chair (not shown), within personal control devices (e.g. joysticks, remote controls, game pads, roller-balls, touch-pads, touch-screens, etc.), within the web-cam 835, or any other external device. The external devices can be connected to the computer 830 or to the game control device 810 via the input/output ports 818. As a security feature, some biometric devices can be associated with some of the gaming pad devices (e.g., the magnetic card reader 804), such as a fingerprint scanner, a retinal scanner, a signature pad to recognize a player's signature, etc. The game control device 810 can also use the keys 820 to share items and control avatars, icons, game activity, movement, etc. within a network wagering venue. The game pad can also have an electronic (e.g., digital) button panel 825, an electronic control panel 823, or any other type of changeable panel that can change appearance and/or configuration based on the game being played, the action being performed, and/or other activity presented within an online gaming venue. The game control device 810 can also move in different directions to control activity within the online gaming venue (e.g., movement of a player's avatar moves in response to the movements of the game control device 810). Avatars can be pre-programmed to act and look in certain ways, which the player can control using the system 800. The gaming pad 802 can permit the player to move the avatar fluidly and more easily than is possible using a standard keyboard. The system 800 can cause an avatar to respond to input that a player receives via the gaming pad 802. For example, a player may hear a sound that comes primarily from one direction (e.g., via stereophonic signals in the headset 836) within the network wagering venue. The system 800 can detect the movement of the player (e.g., the system 800 detects that a player moves his head to look in the direction of the sound, the player uses the game control device 810 to move the avatar's perspective to the direction of the sound, etc.). The system 800 can consequently move the avatar's head and/or the avatar's perspective in response to the player's movement. The player can indicate an expression of an emotion indicated by the player using the keys 820. The system 800 can make the avatar's appearance change to reflect the indicated emotion. The system 800 can respond to other movements or actions by the player and fluidly move the avatar to respond. The system 800 can also interpret data provided by the biometric devices and determine expressions and/or indications of emotions for a player using the system 800.

Wagering Game Machine Architecture

Figure 9:
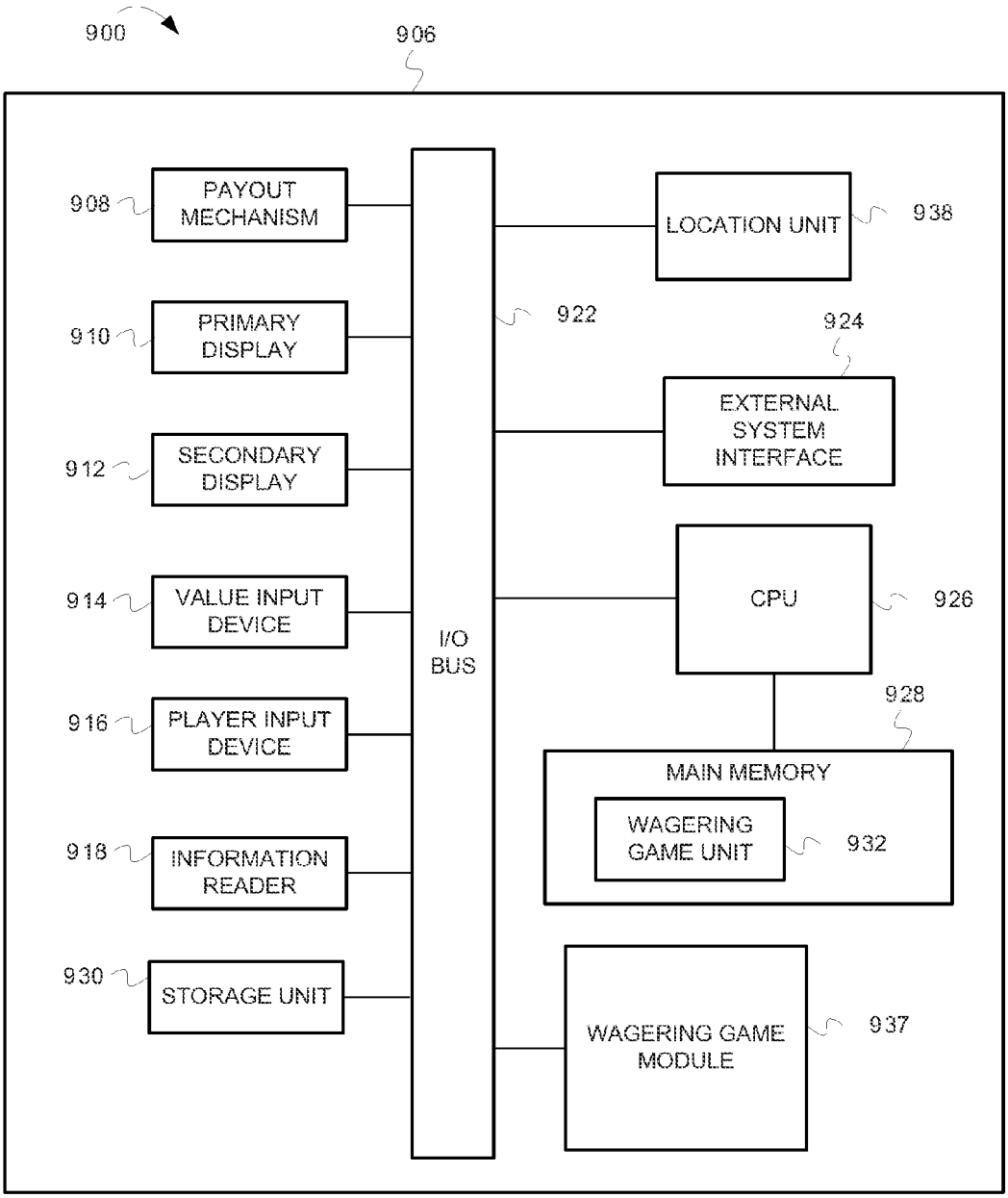
FIG. 9 is an illustration of a wagering game machine architecture 900, according to some embodiments.

FIG. 9 is a conceptual diagram that illustrates an example of a wagering game machine architecture 900, according to some embodiments. In FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932. In some embodiments, the wagering game unit 932 can present wagering games, such as video poker, video black jack, video slots, video lottery, reel slots, etc., in whole or part.

The CPU 926 is also connected to an input/output ("I/O") bus 922, which can include any suitable bus technologies, such as an AGTL+ frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems (e.g., wagering game networks). The external system interface 924 can include logic for exchanging information over wired and wireless networks (e.g., 902.11g transceiver, Bluetooth transceiver, Ethernet transceiver, etc.)

The I/O bus 922 is also connected to a location unit 938. The location unit 938 can create player information that indicates the wagering game machine's location/movements in a casino. In some embodiments, the location unit 938 includes a global positioning system (GPS) receiver that can determine the wagering game machine's location using GPS satellites. In other embodiments, the location unit 938 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 9, in some embodiments, the location unit 938 is not connected to the I/O bus 922.

In some embodiments, the wagering game machine 906 can include additional peripheral devices and/or more than one of each component shown in FIG. 9. For example, in some embodiments, the wagering game machine 906 can include multiple external system interfaces 924 and/or multiple CPUs 926. In some embodiments, any of the components can be integrated or subdivided.

In some embodiments, the wagering game machine 906 includes a wagering game module 937. The wagering game module 937 can process communications, commands, or other information, where the processing can control interactivity between bingo games and additional wagering games.

Furthermore, any component of the wagering game machine 906 can include hardware, firmware, and/or machine-readable storage media including instructions for performing the operations described herein.

Wagering Game Machine

Figure 10:
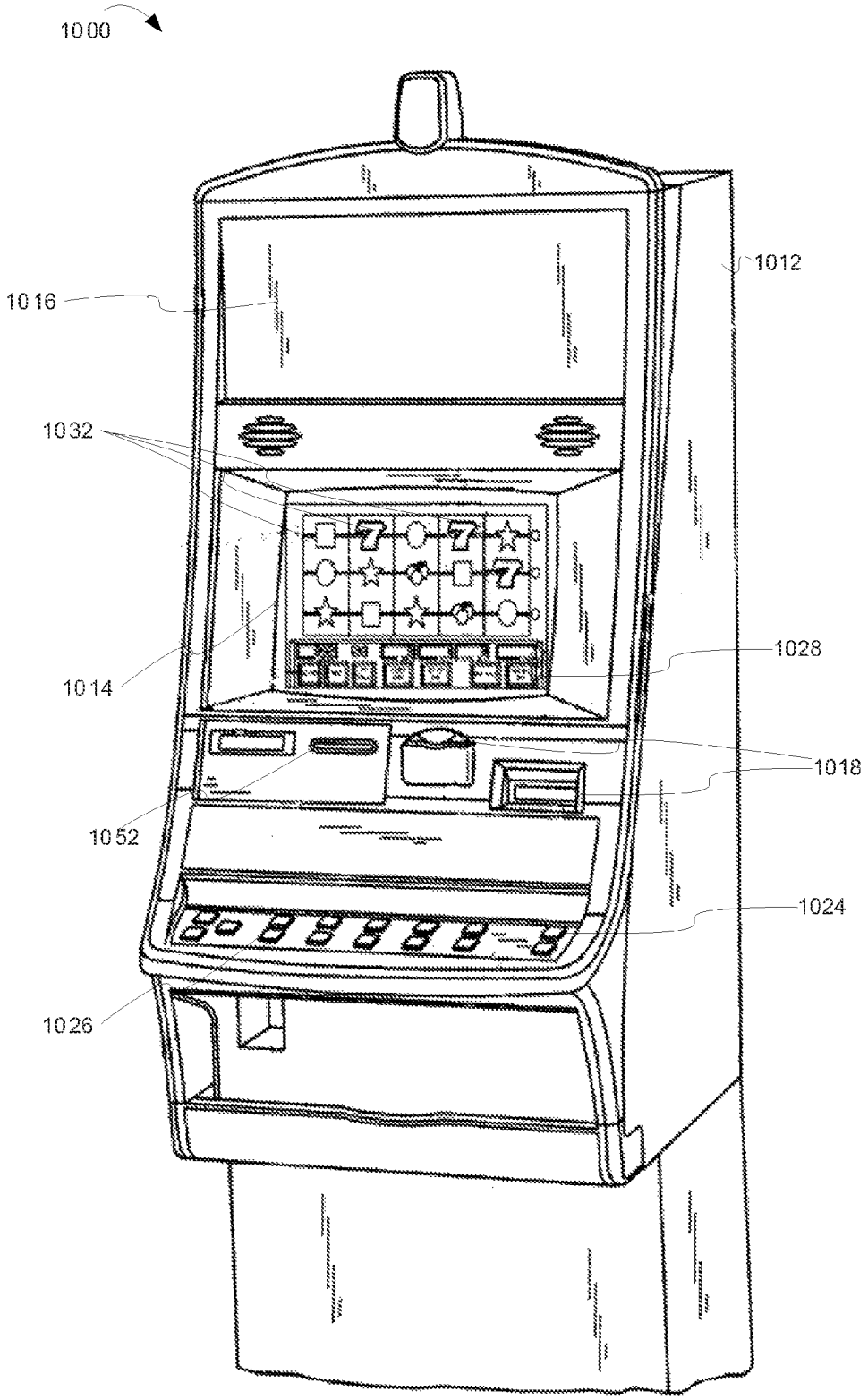
FIG. 10 is an illustration of a wagering game machine 1000, according to some embodiments.

FIG. 10 is a conceptual diagram that illustrates an example of a wagering game machine 1000, according to some embodiments. Referring to FIG. 10, the wagering game machine 1000 can be used in gaming establishments, such as casinos. According to some embodiments, the wagering game machine 1000 can be any type of wagering game machine and can have varying structures and methods of operation. For example, the wagering game machine 1000 can be an electromechanical wagering game machine configured to play mechanical slots, or it can be an electronic wagering game machine configured to play video casino games, such as blackjack, slots, keno, poker, blackjack, roulette, etc.

The wagering game machine 1000 comprises a housing 1012 and includes input devices, including value input devices 1018 and a player input device 1024. For output, the wagering game machine 1000 includes a primary display 1014 for displaying information about a basic wagering game. The primary display 1014 can also display information about a bonus wagering game and a progressive wagering game. The wagering game machine 1000 also includes a secondary display 1016 for displaying wagering game events, wagering game outcomes, and/or signage information. While some components of the wagering game machine 1000 are described herein, numerous other elements can exist and can be used in any number or combination to create varying forms of the wagering game machine 1000.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or barcode scanners for reading information stored on vouchers, cards, or other tangible portable storage devices. The vouchers or cards can authorize access to central accounts, which can transfer money to the wagering game machine 1000.

The player input device 1024 comprises a plurality of push buttons on a button panel 1026 for operating the wagering game machine 1000. In addition, or alternatively, the player input device 1024 can comprise a touch screen 1028 mounted over the primary display 1014 and/or secondary display 1016.

The various components of the wagering game machine 1000 can be connected directly to, or contained within, the housing 1012. Alternatively, some of the wagering game machine's components can be located outside of the housing 1012, while being communicatively coupled with the wagering game machine 1000 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 1000. Alternatively, the primary display 1014 can include a number of mechanical reels to display the outcome. In FIG. 10, the wagering game machine 1000 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 1000. In yet another embodiment, the wagering game machine 1000 can exhibit any suitable form factor, such as a free standing model, bar top model, mobile handheld model, or workstation console model.

A player begins playing a basic wagering game by making a wager via the value input device 1018. The player can initiate play by using the player input device's buttons or touch screen 1028. The basic game can include arranging a plurality of symbols 1032 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 1000 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product, or software, that may include a machine-readable storage medium having stored thereon instructions, which may be used to program a computer system (or other electronic device(s)) to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system configured to provide electronic wagering games, said method comprising:

providing, via the gaming system, gaming content for presentation of an electronic bingo game via an electronic display device, wherein the gaming content includes a video representation of a bingo game card including card identifiers arranged in a distinct pattern on the bingo game card, and wherein the card identifiers are usable to track matching game identifiers drawn during the electronic bingo game;

selecting, in response to user input to the gaming system, one of the card identifiers, wherein the selecting indicates a user prediction that a matching game identifier will be drawn during the electronic bingo game;

associating, via the gaming system, the selecting of the one of the card identifiers with a secondary wagering game;

setting a minimum bet limit for each betting round of the secondary wagering game, wherein the minimum bet limit is configured to change for the each betting round according to a number of game identifiers that have been drawn for the electronic bingo game prior to the each betting round;

placing, via the gaming system, a bet on the selecting of the one of the card identifiers, wherein the bet is for the secondary wagering game, and wherein the bet complies with the minimum bet limit;

detecting, via the gaming system, that the matching game identifier is drawn for the electronic bingo game; and transacting the bet, via the gaming system, in response to the detecting that the matching game identifier is drawn.

2. The method of claim 1 further comprising:

determining a first time period of game play for the electronic bingo game; and limiting a second time period of game play for the secondary wagering game based on the first time period of game play for the electronic bingo game.

3. The method of claim 1 wherein the electronic bingo game and the secondary wagering game operate independently from each other, and wherein the placing the bet for the secondary wagering game has no impact on game play for the electronic bingo game.

4. The method of claim 1 further comprising:

selecting, at random, a customized graphic provided via additional player input, wherein the additional player input is associated with a wagering game player account;

presenting the customized graphic on the video representation of the bingo game card as being associated with the one of the card identifiers for the electronic bingo game; and awarding the wagering game player account with a multiplier for the bet in the secondary wagering game, in response to the customized graphic being presented on the video representation of the bingo game card.

5. The method of claim 1 further comprising:

providing an interface for the secondary wagering game, and detecting an additional user input, via the interface, wherein the additional user input indicates a bet value for the bet.

6. The method of claim 1 further comprising:

randomly selecting the matching game identifier for the electronic bingo game, and providing an indication of the matching game identifier to the secondary wagering game via an application programming interface.

7. The method of claim 1 further comprising:

presenting an additional wagering game in response to the detecting that the matching game identifier is drawn;

determining that the matching game identifier results in a winning outcome for the additional wagering game; and providing a reward for the winning outcome for the additional wagering game.

8. The method of claim 1, wherein the selecting the one of the card identifiers is before the matching game identifier has been drawn, and wherein the selecting the one of the card identifiers is after an additional one of the game identifiers has been drawn for the electronic bingo game.

9. The method of claim 1 comprising setting the minimum bet limit for the bet according to a value of odds that the matching game identifier will be drawn based on a number of game identifiers that have been drawn for the electronic bingo game prior to the one of the card identifiers being selected.

10. A gaming apparatus configured to provide electronic wagering games, said gaming apparatus comprising:

means for graphically presenting a bingo game card via an electronic display device, wherein the bingo game card comprises card identifiers that are a subset of game identifiers that can be drawn during a bingo game, and wherein the card identifiers are for tracking when matching ones of the subset of game identifiers are drawn for the bingo game;

means for detecting player selection of a portion of the card identifiers, wherein the player selection indicates a player prediction that a certain of the game identifiers will be drawn during the bingo game;

means for associating the portion of the card identifiers with a secondary wagering game, wherein the bingo game and the secondary wagering game operate independently from each other;

means for setting a minimum bet limit for each betting round of the secondary wagering game, wherein the minimum bet limit is configured to change for the each betting round proportional to a number of the game identifiers that have been drawn for the bingo game prior to the each betting round;

means for placing a bet on the player prediction that the certain of the game identifiers will be drawn during the bingo game, wherein the bet is for the secondary wagering game complies with the minimum bet limit;

means for detecting that the certain of the game identifiers are drawn for the bingo game;

means for transacting the bet without impacting the bingo game; and means for providing an award for the secondary wagering game in response to the transacting the bet.

11. The gaming apparatus of claim 10, wherein the means for placing the bet comprises:

means for presenting a betting control that receives bets for the secondary wagering game; and means for detecting an additional player input via the betting control, wherein the additional player input indicates a bet value.

12. The gaming apparatus of claim 10 further comprising:
means for determining a first time period of game play for the bingo game; and
means for limiting a second time period of game play for the secondary wagering game based on the first time period of game play for the bingo game.

13. The gaming apparatus of claim 10 further comprising:
means for selecting, at random, a customized graphic provided by a wagering game player account associated with the bingo game;
means for presenting the customized graphic on the bingo game card in association with the one of the card identifiers; and
means for entering the wagering game player account into a sweepstakes based on the presenting the customized graphic on the bingo game card.

14. The gaming apparatus of claim 10, wherein the means for detecting that the certain of the game identifiers are drawn during the bingo game comprises:
means for generating random numbers for the bingo game;
means for using the random numbers to draw the certain of the game identifiers; and
means for notifying the secondary wagering game of that the of the game identifiers are drawn.

15. The gaming apparatus of claim 10, wherein the means for detecting the player selection of the portion of the card identifiers comprises means for selecting the portion of the card identifiers after at least one of the game identifiers has been drawn for the bingo game and before the certain of the game identifiers have been drawn.

16. The gaming apparatus of claim 10, wherein the means for setting the minimum bet limit comprises:
means for determining, for a betting round associated with the bet, a probability that the certain of the game identifiers will be drawn during the bingo game based on the number of the game identifiers that have been drawn for the bingo game prior to the betting round; and
means for setting the minimum bet limit proportional to the probability.

17. A gaming system comprising:
one or more electronic wagering game controllers configured to present one or more electronic wagering games;
an electronic display device; and
one or more memory units configured to store instructions which, when executed by at least one of the one or more electronic wagering game controllers, cause the gaming system to
present first gaming content for a bingo game via the electronic display device, wherein the gaming content includes a bingo game card including card identifiers arranged on the bingo game card, and wherein the card identifiers are for tracking matching game identifiers drawn during the bingo game,
present, via the electronic display device, second gaming content for a secondary wagering game independent from the bingo game,
set a minimum betting limit for each betting round of the secondary wagering game, wherein the minimum betting limit is configured to change for the each betting round according to a number of the game identifiers that have been drawn for the bingo game prior to the each betting round, and
place a bet in the secondary wagering game, wherein the bet complies with the minimum betting limit, and wherein the bet is based on a user prediction that a specific one of the matching game identifiers will be drawn within a specific number of draws of the bingo game after the placement of the bet.

18. The gaming system of claim 17, wherein the one or more memory units are configured to store instructions which, when executed by at least one of the one or more electronic wagering game controllers, further cause the gaming system to
detect, after the bet is placed, that the specific one of the matching game identifiers is drawn during the bingo game within the specific number of draws, and
pay a reward for the bet according to a number of the game identifiers that have been drawn prior to the specific one of the matching game identifiers being drawn.

19. The gaming system of claim 17, wherein the one or more memory units are configured to store instructions which, when executed by at least one of the one or more electronic wagering game controllers, further cause the gaming system to
before placement of the bet, detect a first user input that specifies the specific one of the matching game identifiers, and
detect a second user input that specifies the specific number of draws.

20. The gaming system of claim 17, wherein the minimum betting limit comprises one or more of a minimum bet amount and a minimum bet increment amount.

21. The gaming system of claim 17, wherein the one or more memory units are configured to store instructions which, when executed by at least one of the one or more electronic wagering game controllers, further cause the gaming system to set the minimum betting limit based on a probability of occurrence of the specific one of the matching game identifiers within the specific number of draws.

22. The gaming system of claim 17, wherein the one or more memory units are configured to store instructions which, when executed by at least one of the one or more electronic wagering game controllers, further cause the gaming system to:
detect that the specific one of the matching game identifiers is drawn for the bingo game;
select an avatar associated with a wagering game player account;
associate the avatar with one of the card identifiers that corresponds to the specific one of the matching game identifiers; and
award the wagering game player account in response to the associating the avatar with the one of the card identifiers.

23. The gaming system of claim 17, wherein the one or more memory units are configured to store instructions which, when executed by at least one of the one or more electronic wagering game controllers, further cause the gaming system to:
detect that the specific one of the matching game identifiers is drawn for the bingo game; and
cause an event to occur for an additional wagering game separate from the bingo game and separate from the secondary wagering game in response to the specific one of the matching game identifiers being drawn.

24. The gaming system of claim 17, wherein the one or more memory units are configured to store instructions which, when executed by at least one of the one or more electronic wagering game controllers, further cause the gaming system to:
compute odds that the specific one of the matching game identifiers will be drawn for the bingo game based on the number of the game identifiers that have been drawn for the bingo game prior to the bet being placed; and
set the minimum betting limit proportional to the odds.

* * * * *